US009255481B2

(12) United States Patent
Lim

(10) Patent No.: US 9,255,481 B2
(45) Date of Patent: Feb. 9, 2016

(54) TURBINE IMPELLER COMPRISING BLADE WITH SQUEALER TIP

(71) Applicant: HANWHA TECHWIN CO., LTD., Changwon-Si (KR)

(72) Inventor: Chan-sun Lim, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 537 days.

(21) Appl. No.: 13/706,522

(22) Filed: Dec. 6, 2012

(65) Prior Publication Data

US 2013/0142651 A1 Jun. 6, 2013

(30) Foreign Application Priority Data

Dec. 6, 2011 (KR) ..... 10-2011-0129907

(51) Int. Cl.
*F01D 5/20* (2006.01)
*F01D 5/14* (2006.01)

(52) U.S. Cl.
CPC . *F01D 5/145* (2013.01); *F01D 5/20* (2013.01)

(58) Field of Classification Search
CPC ..... F01D 5/20; F01D 5/186; F01D 11/10; F01D 5/145; F01D 5/18; F01D 5/187; F01D 11/08; F01D 2260/202; F01D 2240/307
See application file for complete search history.

(56) References Cited

U.S. PATENT DOCUMENTS 4,424,001 A 1/1984 North et al.
5,183,385 A * 2/1993 Lee et al. ..... 416/97 R
5,403,158 A * 4/1995 Auxier ..... 416/97 R
5,480,284 A * 1/1996 Wadia et al. ..... 416/91
5,503,527 A 4/1996 Lee et al.
5,927,946 A * 7/1999 Lee ..... 416/97 R
6,059,530 A * 5/2000 Lee ..... 416/97 R
6,231,307 B1 5/2001 Correia
6,422,821 B1 * 7/2002 Lee et al. ..... 416/224
6,478,537 B2 11/2002 Junkin
6,602,052 B2 * 8/2003 Liang ..... 416/97 R
7,238,001 B2 * 7/2007 Rushton ..... 415/110
7,934,906 B2 5/2011 Gu et al.
8,133,008 B2 * 3/2012 Tsuchiya ..... 415/115
8,133,032 B2 * 3/2012 Tibbott et al. ..... 416/235
8,454,310 B1 * 6/2013 Downs ..... 416/1
8,568,090 B2 * 10/2013 Guo et al. ..... 415/169.1
8,672,629 B2 * 3/2014 Botrel et al. ..... 416/92
8,764,380 B2 * 7/2014 Harvey et al. ..... 415/115
8,801,377 B1 * 8/2014 Liang ..... 416/97 R
2002/0090301 A1 * 7/2002 Lee et al. ..... 416/224
2002/0197160 A1 * 12/2002 Liang ..... 416/92

(Continued)

FOREIGN PATENT DOCUMENTS

JP 2000345803 A 12/2000
KR 1020110005902 A 1/2011

OTHER PUBLICATIONS

Communication dated Apr. 19, 2013 from the Korean Intellectual Property Office in counterpart application No. 10-2011-0129907.

*Primary Examiner* — Nathaniel Wiehe
*Assistant Examiner* — Eldon Brockman
(74) *Attorney, Agent, or Firm* — Sughrue Mion, PLLC

(57) ABSTRACT

A turbine impeller including a rotor; a blade extending from the rotor from a first end of the blade; and a squealer tip provided at a second end opposite to the first end of the blade, wherein at least one perforated portion penetrates through the squealer tip.

4 Claims, 6 Drawing Sheets

(56) References Cited

U.S. PATENT DOCUMENTS

2009/0162200 A1* 6/2009 Tibbott et al. ..... 416/91
2009/0220332 A1* 9/2009 Tsuchiya ..... 415/115
2010/0111704 A1 5/2010 Hada
2011/0135447 A1* 6/2011 Guo et al. ..... 415/115
2011/0135496 A1* 6/2011 Botrel et al. ..... 416/96 R

* cited by examiner

TURBINE IMPELLER COMPRISING BLADE WITH SQUEALER TIP

RELATED APPLICATIONS

This application claims the benefit of Korean Patent Application No. 10-2011-0129907, filed on Dec. 6, 2011 in the Korean Intellectual Property Office, the disclosures of which are incorporated herein by reference in their entirety.

BACKGROUND

1. Field

Apparatuses consistent with one or more exemplary embodiments relate to a structure of a turbine impeller including a blade with a squealer tip for preventing thermal damage and for featuring high efficiency.

2. Description of the Related Art

A turbine is a device for producing power by using an energy generated as a high temperature and high pressure fluid flows in the turbine and expands. In the related art, the turbine includes one or more turbine impellers. Each turbine impeller includes a rotor located at the center and a plurality of blades extending in a long shape from a surface of the rotor. The rotor and the blades that are formed as a single body is accommodated in a shroud. The single body of the rotor and the blades rotates, and produces power.

Particularly, in case of an axial turbine, a fluid flows in a direction almost parallel to the rotating axis of a turbine impeller, and the fluid flowed into the turbine flows and contacts blades, thereby rotating the turbine impeller. Here, an end of a blade is located at a predetermined distance apart from the shroud to prevent the blade from being damaged and to allow smooth revolution. However, the fluid passing through the gap between the end of the blade and the shroud cannot contribute the production of energy via revolution of the turbine impeller at all. Therefore, the fluidic energy of the fluid through gap is wasted.

To prevent deterioration of efficiency of a turbine due to the fluid leaked through such a gap, a squealer tip is formed at an end of a blade close to a shroud.

The squealer tip is a protrusion which is formed at an end of a blade having a airfoil-like cross-sectional shape and has a predetermined height, where an airfoil-like groove is formed at an end of a blade having a squealer tip.

SUMMARY

One or more exemplary embodiments provide a turbine impeller including a blade which reduces thermal damage of the blade by preventing formation of hot spots in a squealer tip and around the blade and embodies high efficiency.

Additional aspects will be set forth in part in the description which follows and, in part, will be apparent from the description, or may be learned by practice of the presented exemplary embodiments.

According to an aspect of an exemplary embodiment, there is provided a turbine impeller includes a rotor; a blade extending from the rotor from a first end of the blade; and a squealer tip provided at a second end opposite to the first end of the blade, wherein at least one perforated portion penetrates through the squealer tip.

A first perforated portion of the at least one perforated portion may penetrate through a portion of a pressure surface of the blade closer to a leading edge than to a trailing edge. A fluid flows from outside of the blade into the squealer tip via the first perforated portion of the pressure surface of the blade, and a cross-sectional area of the first perforated portion of the pressure surface of the blade may decrease in a direction from the outside of the blade to an interior of the squealer tip.

A second perforated portion of the at least one perforated portion may penetrate through a portion of an absorbing surface of the blade closer to the trailing edge than to the leading edge. A fluid may flow from the interior of the squealer tip to outside of the blade via the second perforated portion, and a cross-sectional area of the second perforated portion may decrease in a direction from the interior of the squealer tip to outside of the blade.

Surfaces of the squealer tip contacting the perforated portion may include streamline shapes.

According to another aspect of an exemplary embodiment, there is provided a blade extending from a rotor of a turbine impeller including: a base portion provided at a first end attached to the rotor; a pressure side airfoil; a absorption side airfoil; a tip provided at a second end opposite of the first end of the blade including: a pressure side squealer tip; a suction side squealer tip; and a groove disposed between the pressure side and absorption side squealer tips, wherein a plurality of perforated portions penetrates through each of the pressure side and the absorption side squealer tips.

A cross-sectional area of each of the plurality of perforated portions of the blade may decrease in a direction from the pressure side airfoil to the absorption side of the airfoil.

Surfaces of the pressure and absorption side squealer tips contacting the plurality of perforated portions may include streamline shapes.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

Figure 1:
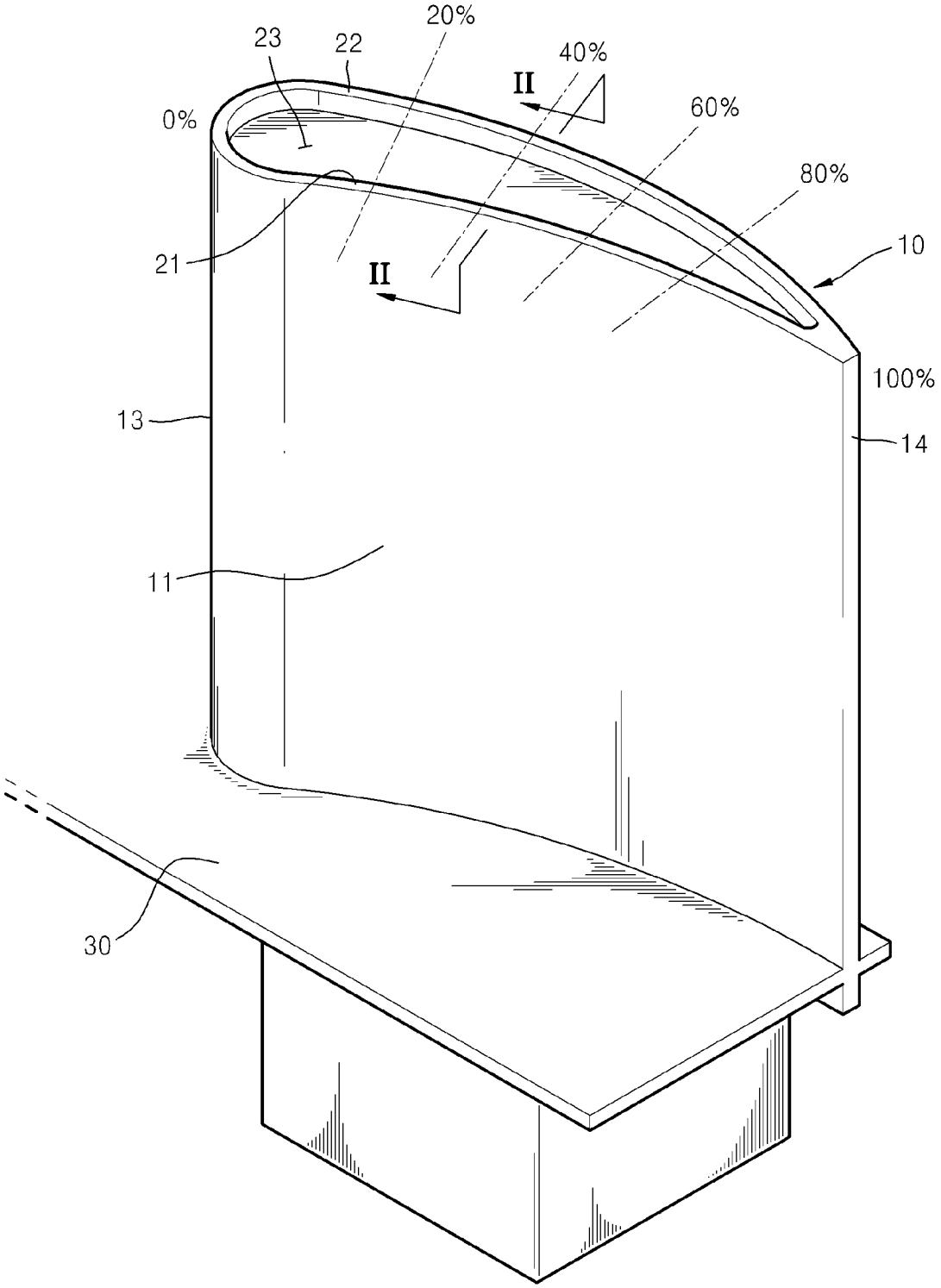
FIG. 1 is a diagram partially showing a turbine impeller having a blade with thereat squealer tips in the related art.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
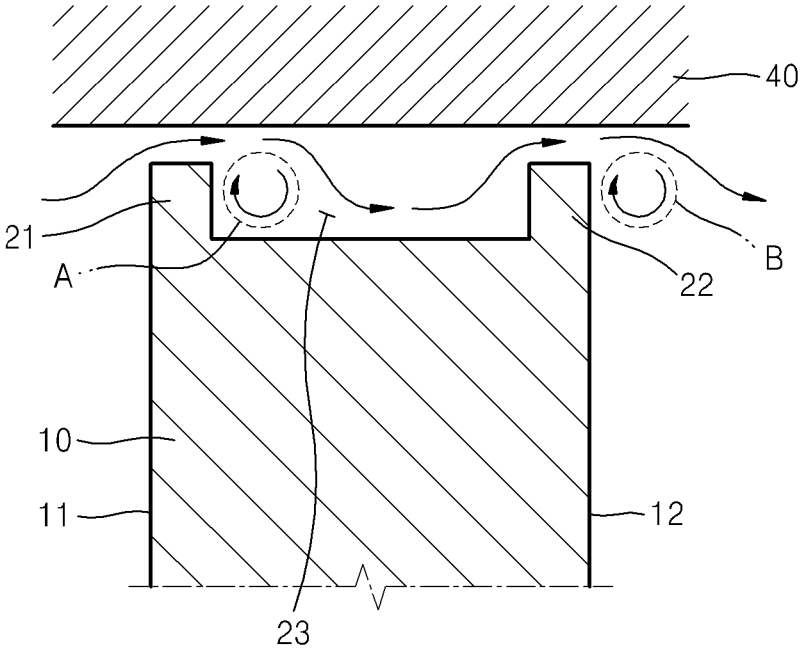
FIG. 2 is a diagram showing the blade shown in FIG. 1 viewed in a direction along a line II-II and showing flow of a fluid via a partial cross-section of the shroud.
Figure 3A:
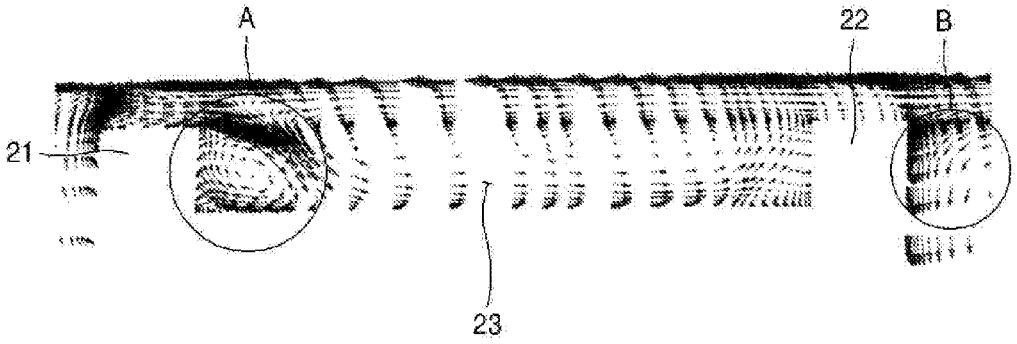
FIGS. 3A, 3B, and 3C are diagrams showing flows around at 20%, 40%, and 60% cross section along an axial axis from a leading edge to a trailing edge of the blade shown in FIG. 1, respectively.
Figure 3B:
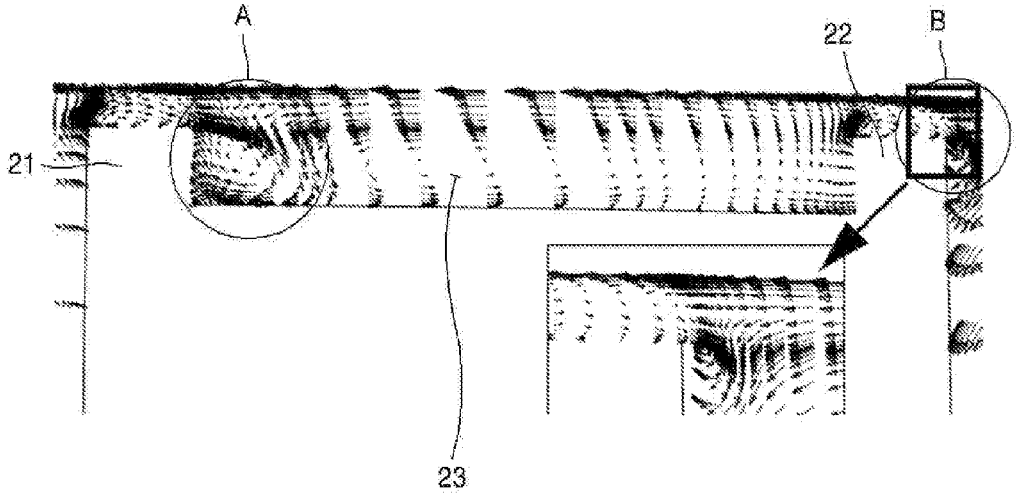
Figure 3C:
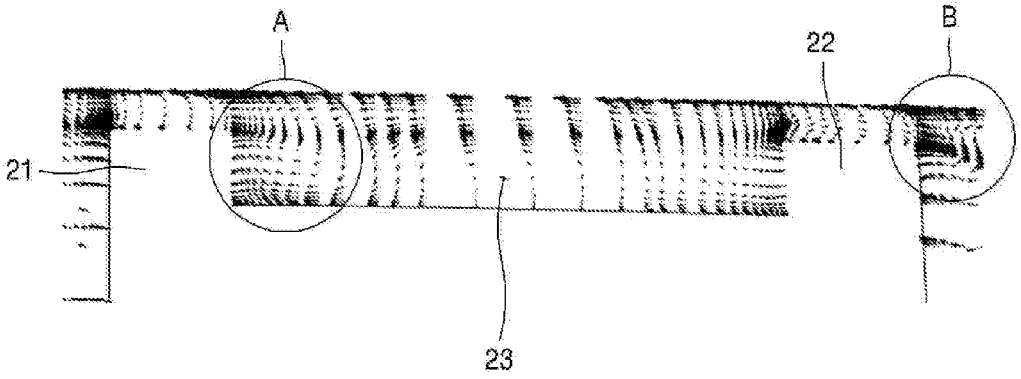

FIG. 1 is a diagram partially showing a turbine impeller having a blade 10 with thereat squealer tips 21 and 22 in the related art. FIG. 2 is a diagram showing the blade 10 shown in FIG. 1 viewed in a direction along a line II-II and showing flow of a fluid via a partial cross-section of the shroud 40. FIGS. 3A, 3B, and 3C are diagrams showing flows around at 20%, 40%, and 60% cross section along an axial axis from a leading edge 13 to a trailing edge 14 of the blade 10 shown in FIG. 1, respectively.

FIG. 1 shows the blade 10 including the squealer tips 21 and 22 and a rotor 30, where the blade 10 is located inside the shroud 40.

A plurality of blades 10 are formed at the rotor 30. The rotor 30 and the blades 10 are located inside the shroud 40. FIG. 1 shows a portion of the rotor 30 and only one of the blades 10 extending therefrom. Furthermore, the blade 10 is arranged, such that a tip of the blade 10 is a predetermined distance apart from the shroud 40.

The blade 10 has an airfoil-like cross-section and has a long shape extending from the rotor 30 in a direction. The blade 10 includes a leading edge 13, which is the front portion of each airfoil-like cross-section, located in the upstream of flow of a fluid, and initially contacts the fluid, and a trailing edge 14, which is the rear portion of each airfoil-like cross-section and located where two portions of a fluid separated by the blade 10 are combined again. Furthermore, based on the leading edge 13 and the trailing edge 14, side surfaces of the blade 110 includes a pressure surface 11, at which a fluid passing around the blade 10 has a relatively high pressure, and an absorbing surface 12, at which a fluid passing around the blade 10 has a relatively low pressure.

As shown in FIG. 2, a fluid flows in via a gap formed between the blade 10 and the shroud 40. As the fluid passes a pressure surface squealer tip 21 formed on the pressure surface 11 and flows into the interior of the squealer tip 23, flow separation takes place at a region A. Here, amount of additional fluid flowing into the region A decreases due to resistance resulted from the flow separation. At the same time, a high temperature and high pressure fluid forms a vortex, which does not move and stays at the region A, and thus a hot spot at which the blade 10 is locally heated is formed. FIGS. 3A through 3C provide detailed views thereof.

An excessive thermal stress applies to a portion of the blade 10 with the hot spot, thereby causing thermal damages to the blade 10. Therefore, if there is no suitable cooling process, the blade 10 may be destroyed, and destruction of the blade 10 may cause serious defects not only to a turbine, but also to an engine including the turbine. Here, the region A is formed at a location in the interior 23 of the squealer tip relatively close to the pressure surface 11 and a leading edge 13.

Furthermore, the fluid which flowed into the interior 23 of the squealer tip passes through a gap formed between the absorbing surface squealer tip 22, which is formed on an absorbing surface 12, and the shroud 40. Another flow separation may likely occur in a region B. The flow separation is induced by a fluid which leaked from the interior 23 of the squealer tip over the absorbing surface squealer tip 22 and a fluid which moves from the leading edge 13 along the absorbing surface 12. Like the region A as described above, the flow separation applies thermal stress to the blade 10. Furthermore, the flow separation disturbs flow of a fluid flowing along the absorbing surface 12, thereby deteriorating efficiency of a turbine.

Particularly, FIGS. 3A and 3B are diagrams showing flow of a fluid in regions corresponding to 20% and 40% cross section of FIG. 1, respectively. FIGS. 3A and 3B show that the fluid is relatively stagnant in the region A compared to the other regions. Furthermore, FIGS. 3B and 3C are diagrams showing flow of a fluid in regions corresponding to 40% and 60% of FIG. 1, respectively. FIGS. 3B and 3C show that the fluid is relatively stagnant in the region B compared to the other regions. In other words, FIGS. 3A through 3C show vortexes formed in the regions A and B as described above. Problems due to the formation of the vortexes are as described above.

Accordingly, the blade 10 including the squealer tips 21 and 22 has problems including thermal cracks due to formation of hot spots based on vortexes formed inside the squealer tips 21 and 22 and deterioration of efficiency due to flow separation formed on the absorbing surface 12.

Hereinafter, exemplary embodiments will be described in detail with reference to the attached drawings.

Figure 4:
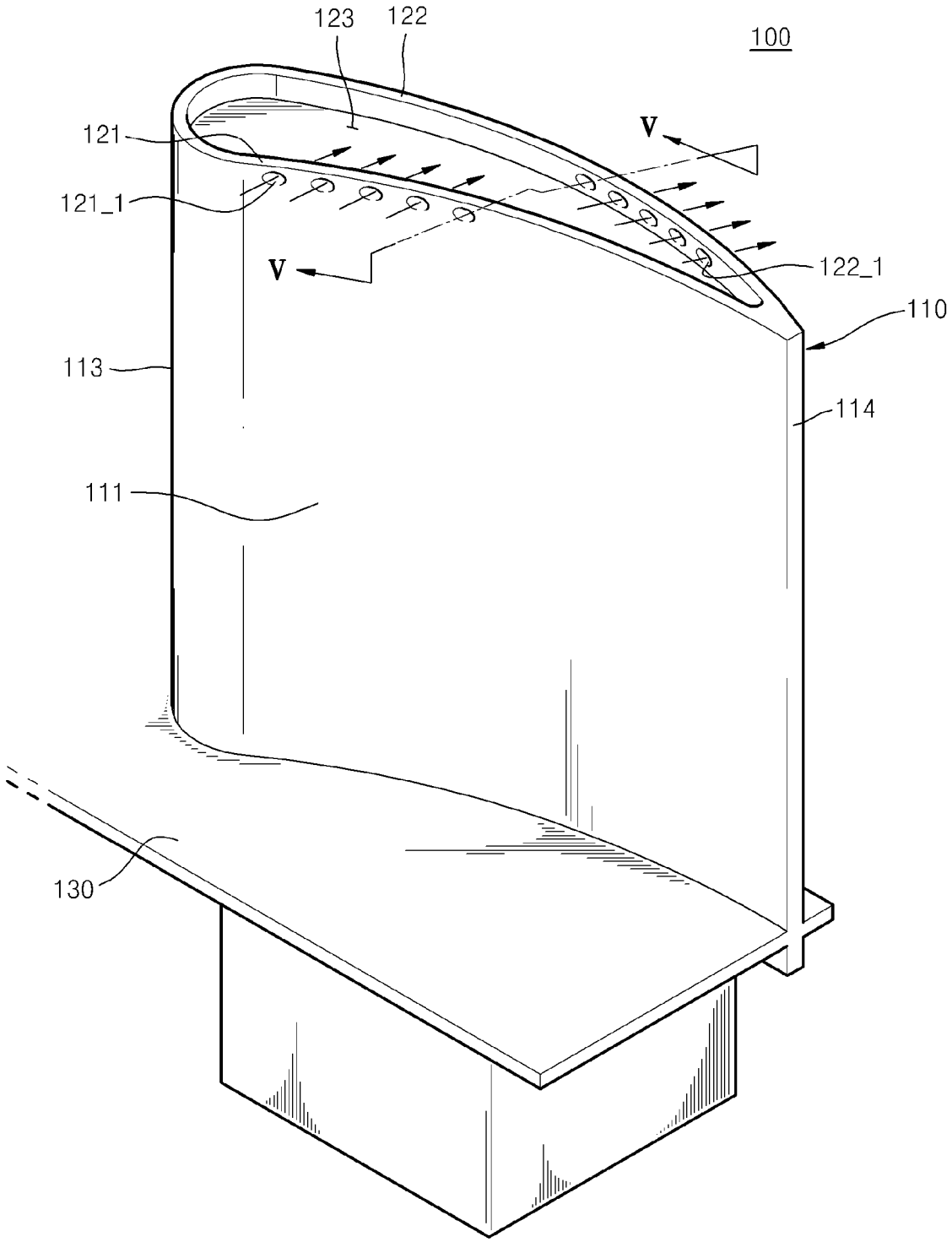
FIG. 4 is a diagram partially showing a turbine impeller including a blade having thereat squealer tips.
Figure 5:
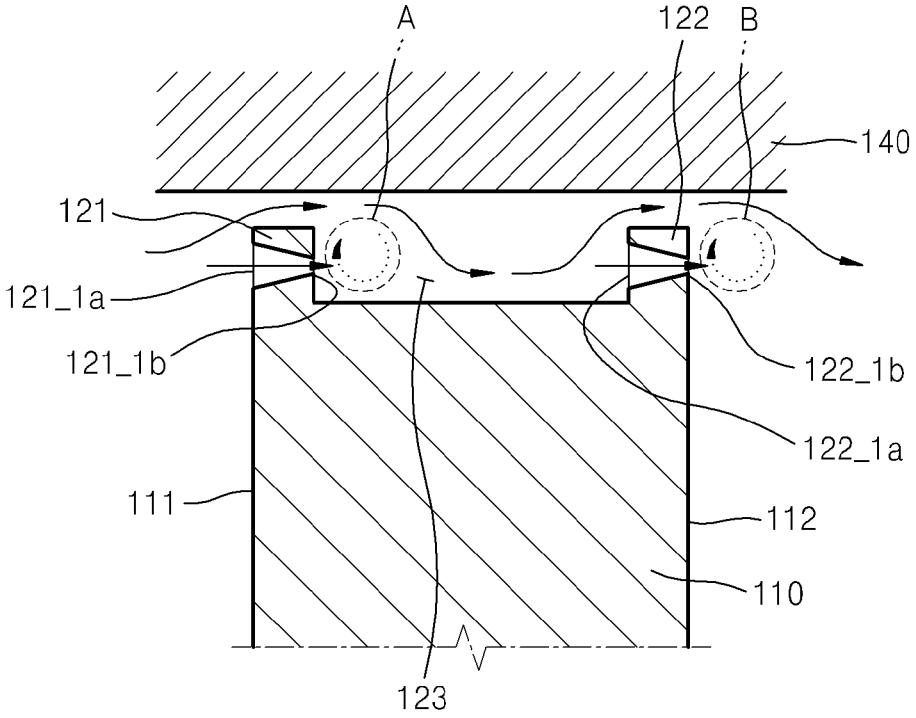
FIG. 5 is a diagram showing the blade shown in FIG. 4 viewed in a direction along a line V-V and showing flow of a fluid via a partial cross-section of a shroud which accommodates the blade.
Figure 6:
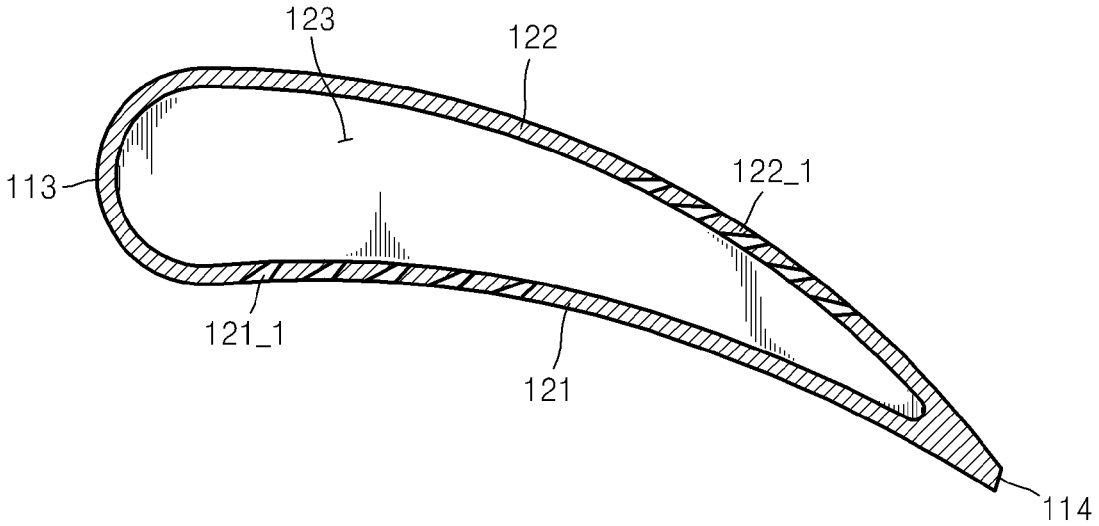
FIG. 6 is a plan view of the blade shown in FIG. 5

FIG. 4 is a diagram partially showing a turbine impeller 100 including a blade 110 having thereat squealer tips 121 and 122. FIG. 5 is a diagram showing the blade 110 shown in FIG. 4 viewed in a direction along a line V-V and showing flow of a fluid via a partial cross-section of a shroud 140 which accommodates the blade 110. FIG. 6 is a plan view of the blade 110 shown in FIG. 5.

A turbine impeller 100 according to the present exemplary embodiment includes the blade 110 including the squealer tips 121 and 122 and a rotor 130, where the turbine impeller 100 is located inside the shroud 140.

A plurality of blades 110 are formed at the rotor 130. The rotor 130 and the blades 110 are located inside the shroud 140. FIG. 4 shows a portion of the rotor 130 and only one of the blades 110 extending therefrom. Furthermore, the blade 110 is arranged, such that a tip of the blade 110 is a predetermined distance apart from the shroud 140.

The blade 110 has an airfoil-like cross-section and has a long shape extending from the rotor 130 in a direction. The blade 110 includes a leading edge 113, which is the front portion of each airfoil-like cross-section, located in the upstream of flow of a fluid, and initially contacts the fluid, and a trailing edge 114, which is the rear portion of each airfoil-like cross-section and located where two portions of a fluid separated by the blade 110 are combined again. Furthermore, based on the leading edge 113 and the trailing edge 114, side surfaces of the blade 110 includes a pressure surface 111, at which a fluid passing around the blade 110 has a relatively high pressure, and an absorbing surface 112, at which a fluid passing around the blade 110 has a relatively low pressure.

Same as the blade 10 in the related art as described above, squealer tips 121 and 122 are formed at the tip of the blade 110 close to the shroud 140.

Furthermore, at least one perforated portions 121_1 and 122_1 penetrating through the squealer tips 121 and 122 are formed in the squealer tips 121 and 122, respectively.

The perforated portion 121_1 is formed in the pressure surface squealer tip 121, and a fluid flows into the interior 123 of the squealer tip 121 from outside of the blade 110 via the perforated portion 121_1. The perforated portion 121_1 formed in the pressure surface squealer tip 121 eliminates hot spots by forming a strong fluid flow toward a vortex, which is formed inside the interior 123 of the squealer tip 121 and forms hot spots. Therefore, the perforated portion 121_1 may be formed at locations nearby a region of the interior 123 of the squealer tip 121 including a relatively large number of hot spots. Five (5) of the perforated portions 121_1 formed in the present exemplary embodiment shown in FIG. 4 are formed in a region of the pressure surface squealer tip 121 relatively close to the leading edge 113 than the trailing edge 114 of the blade 110. However, the present exemplary embodiment is not limited thereto.

Furthermore, if a fluid flows from the leading edge 113 of the blade 110 along the absorbing surface 112, flow separation takes place due to friction between the fluid and the absorbing surface 112 based on viscosity of the fluid. The flow separation usually occurs around the trailing edge 114, which is in the downstream of a flow on the absorbing surface 112, as described above. Since the flow separation deteriorates efficiency of a turbine, it is necessary to eliminate vortexes formed by the flow separation to improve efficiency of the turbine.

To this end, the perforated portion 122_1 is formed in the absorbing surface squealer tip 122, and a fluid flows from the interior 123 of the squealer tip 121 to the outside of the blade 110 via the perforated portion 122_1. The perforated portion 122_1 formed in the absorbing surface squealer tip 122 eliminates vortexes formed around the absorbing surface 112 due to a flow separation. Another five (5) perforated portions 122_1 formed in the present exemplary embodiment as shown in FIG. 4 are formed in the absorbing surface squealer tip 122. Particularly, the perforated portions 122_1 may be formed in a region of the absorbing surface squealer tip 122 relatively close to the trailing edge 114 than the leading edge 113, where vortexes are frequently formed around the region.

However, the present exemplary embodiment is not limited thereto, and a number, locations, and installation angles of perforated portions may vary.

The perforated portions 121_1 and 122_1 formed in the squealer tips 121 and 122 maintains the advantages of squealer tips 121 and 122 in preventing tip losses occurring at the tip of the blade 110 and resolves problems of squealer tips in the related art. Particularly, as a ratio between height of the blade 110 and a distance between the shroud 140 and the blade 110 increases, tip efficiency of the blade 110 decreases. The squealer tips 121 and 122 improve tip efficiency by reducing a distance between the shroud 140 and the blade 110. However, if heights of the squealer tips 121 and 122 are reduced or grooves are formed in the squealer tips 121 and 122 to eliminate hot spots of the squealer tips 121 and 122, a gap between the shroud 140 and the blade 110 increases, thereby deteriorating tip efficiency. On the contrary, since a perforated portion is formed in a squealer tip according to the present exemplary embodiment, hot spots may be removed without increasing the gap between the shroud 140 and the blade 110, thereby contributing not only to elimination of hot spots, but also to improvement of tip efficiency.

Referring to FIG. 5, a fluid may form vortexes due to flow separation at the region A while the fluid is passing on the pressure surface squealer tip 121, where the vortexes may be eliminated by flow of a fluid flowing in via the perforated portion 121_1 formed in the pressure surface squealer tip 121. In the same regard, vortexes that may be formed in the region B may be eliminated by flow of a fluid flowing out via the perforated portion 122_1 formed in the absorbing surface squealer tip 122. The faster the fluid flows via the perforated portions 121_1 and 122_1, the more efficiently the vortexes may be removed.

The perforated portions 121_1 and 122_1 formed in the squealer tips 121 and 122 may have fluid inlets 121_1*a* and 122_1*a* that are larger than fluid outlets 121_1*b* and 122_1*b*. In the words, the shape of the perforated portions 121_1 and 122_1 functions like nozzles, thereby accelerating flow of fluids flowing in the perforated portions 121_1 and 122_1. The accelerated fluids may remove hot spots and vortexes more efficiently, thereby increasing effects of the exemplary embodiment.

Furthermore, inner surfaces of the perforated portions 121_1 and 122_1 of the squealer tips 121 and 122 may be smooth surfaces to prevent reduction of fluid pressure due to friction between the fluid and the inner surfaces. If the inner surfaces have high friction coefficients, pressure of the fluid is removed while the fluid flows in the perforated portions 121_1 and 122_1, thereby further reducing speed of fluid flowing out of the fluid outlets 121_1*b*, 122_1*b*. As a result, hot spots and vortexes may not be sufficiently removed. Furthermore, if the friction further increases, vortexes may be formed even by the fluids flowing in the perforated portions 121_1 and 122_1, thereby increasing adverse effects of hot spots and vortexes.

Figure 7:
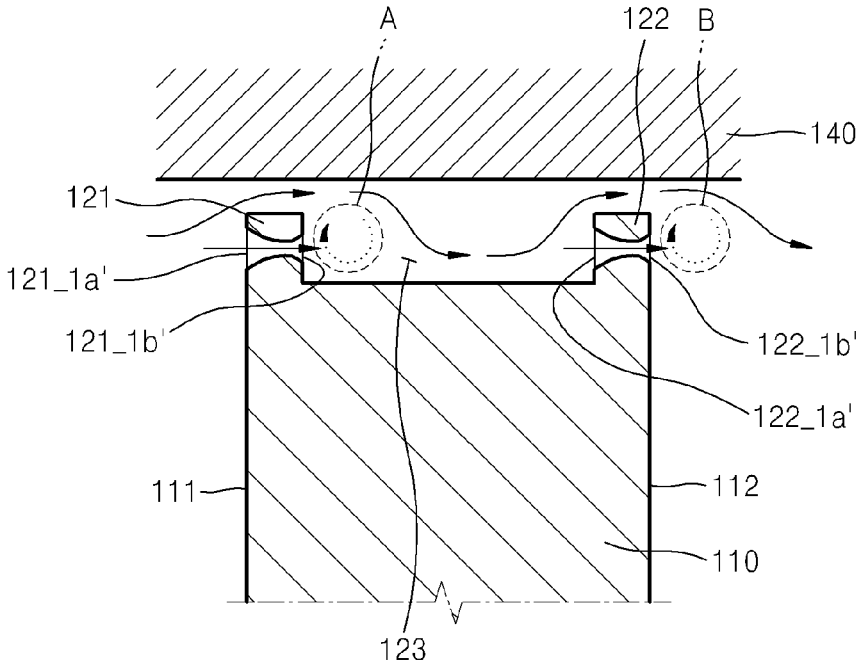
FIG. 7 is a diagram showing a modified example of the blade shown in FIG. 4, showing the blade viewed in the direction along the line V-V and flow of a fluid via a partial cross-section of the shroud accommodating the blade therein.
Figure 8:
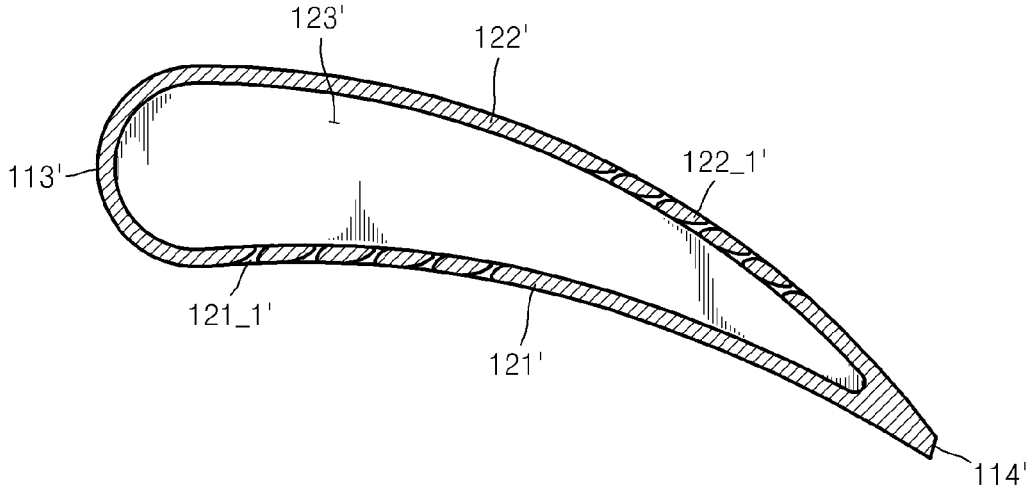
FIG. 8 is a plan view of the blade shown in FIG. 7.

FIG. 7 is a diagram showing a modified example of the blade 110 shown in FIG. 4, showing the blade 110 viewed in the direction along the line V-V and flow of a fluid via a partial cross-section of the shroud 140 accommodating the blade 110 therein. FIG. 8 is a plan view of the blade 110 shown in FIG. 7.

Components of the modified example shown in FIGS. 7 and 8 are identical to those shown in FIGS. 4 through 6 except the perforated portions 121_1 and 122_1 formed in the squealer tips 121 and 122. Therefore, descriptions and reference numerals regarding the components of the modified examples shown in FIGS. 7 and 8 will be replaced with those regarding the components shown in FIGS. 4 and 6 having the same shapes and functions.

In the present exemplary embodiment, surfaces of the squealer tips 121 and 122 contacting the spaces formed by the perforated portions 121_1' and 122_1' may be formed to have streamline shapes to reduce resistances received by a fluid passing through the spaces as much as possible. As shown in FIGS. 5 and 6, if portions of the squealer tips 121 and 122 close to the fluid inlets 121_1*a* and 122_1*a* and the fluid outlets 121_1*b* and 122_1*b* of the perforated portions 121 and 122 are formed to have acutely bent shapes, pressure of a fluid may be dropped when the fluid passes the fluid inlets and the fluid outlets. In other words, according to the present exemplary embodiment, surfaces of the squealer tips 121 and 122 contacting all spaces formed from the fluid inlets 121_1*a*' and 122_1*a*' to the fluid outlets 121_1*b*' and 122_1*b*' of the perforated portions 121_1' and 122_1' are formed to have streamline shapes to reduce pressure drops at the fluid inlets 121_1*a*' and 122_1*a*' and the fluid outlets 121_1*b*' and 122_1*b*' of the perforated portions 121_1' and 122_1' as shown in FIGS. 7 and 8. Therefore, drops of fluid pressure while a fluid flows in the perforated portions 121_1' and 122_1' may be reduced.

As described above, according to the one or more of the above exemplary embodiments, thermal damage of a blade may be reduced and power generation efficiency of a turbine may be improved.

It should be understood that exemplary embodiments described therein should be considered in a descriptive sense only and not for purposes of limitation. Descriptions of features or aspects within each exemplary embodiment should typically be considered as available for other similar features or aspects in other embodiments.

While the exemplary embodiments have been particularly shown and described above, it would be appreciated by those skilled in the art that various changes may be made therein without departing from the principles and spirit of the present inventive concept as defined by the following claims.

What is claimed is:

1. A turbine impeller comprising:

a rotor;

a blade extending from the rotor from a first end of the blade; and a squealer tip provided at a second end of the blade opposite to the first end, wherein at least one perforated portion penetrates through the squealer tip, wherein a first perforated portion of the at least one perforated portion penetrates through a portion of a pressure surface of the blade closer to a leading edge of the blade than to a trailing edge of the blade, wherein a second perforated portion of the at least one perforated portion penetrates through a portion of a suction surface of the blade closer to the trailing edge of the blade than to the leading edge of the blade, wherein the first perforated portion of the pressure surface of the blade is configured to guide a fluid to flow from an exterior of the blade into the squealer tip and the second perforated portion of the suction surface of the blade is configured to guide the fluid from the interior of the squealer tip to the exterior of the blade, wherein a cross-sectional area of the first perforated portion of the pressure surface of the blade decreases in a direction from the exterior of the blade to an interior of the squealer tip, and wherein a cross-sectional area of the second perforated portion of the suction surface of the blade decreases in a direction from the interior of the squealer tip to the exterior of the blade.

2. The turbine impeller of claim 1, wherein surfaces of the squealer tip contacting the at least one perforated portion comprise nozzle shapes.

3. The turbine impeller of claim 1, wherein the cross-sectional area of the first perforated portion continuously decreases from a first surface provided on the exterior of the blade to a second surface provided on the interior of the squealer tip, and wherein the cross-sectional area of the second perforated portion continuously decreases from a third surface provided on the interior of the squealer tip to a fourth surface provided on the exterior of the blade.

4. The turbine impeller of claim 1, wherein each of the first perforated portion and the second perforated portion has a non-divergent nozzle shape.

* * * * *